US005357488A

United States Patent [19]

Udo et al.

[11] Patent Number: 5,357,488

[45] Date of Patent: Oct. 18, 1994

[54] WATCH HAVING A SENSOR

[75] Inventors: Yurie Udo; Toshio Murata, both of Tanashi; Tadashi Nakamura, Tokyo, all of Japan

[73] Assignee: Citizen Watch Co., Ltd., Tokyo, Japan

[21] Appl. No.: 962,585

[22] PCT Filed: Jul. 1, 1991

[86] PCT No.: PCT/JP91/00884

§ 371 Date: Dec. 30, 1992

§ 102(e) Date: Dec. 30, 1992

[87] PCT Pub. No.: WO92/01248

PCT Pub. Date: Jan. 23, 1992

[30] Foreign Application Priority Data

Jul. 3, 1990 [JP] Japan ..... 2-174462
Apr. 19, 1991 [JP] Japan ..... 3-35134[U]

[51] Int. Cl.[5] ..... G04B 47/06
[52] U.S. Cl. ..... 368/11; 73/754

[58] Field of Search ..... 368/11, 10, 294–296, 368/71, 278; 73/291, 384, 386, 437, 753–754

[56] References Cited

U.S. PATENT DOCUMENTS 4,783,772 11/1988 Umemoto et al. ..... 368/11

FOREIGN PATENT DOCUMENTS 61-154585 9/1986 Japan .
62-194431 8/1987 Japan .
63-44781 11/1988 Japan .
1-136484 9/1989 Japan .
2118334B 10/1993 United Kingdom .

*Primary Examiner*—Bernard Roskoski

[57] ABSTRACT

A watch having a sensor, a watch case (2), a sensor holding portion (5) mounted in the watch case, sensor housing spaces (11, 25) formed in the watch case and the holding portion, a sensor protecting tube (15) secured in the spaces in which the sensor (17) is supported.

7 Claims, 4 Drawing Sheets

WATCH HAVING A SENSOR

TECHNICAL FIELD

The present invention relates to a watch having a sensor for sensing an environmental condition such as hydraulic pressure or atmospheric temperature.

BACKGROUND ART

Japanese Utility Model Application Laid-open 1-136484 discloses a watch having a pressure sensor where the sensor is mounted in a side wall of a watch case and a supporting member is provided on the sensor.

Referring to FIG. 7 showing the watch, the watch case comprises a body 52 having a module holding portion 52*a* and a sensor holding portion 52*b*. A glass 53 is mounted on an upper portion of the body 52 through a packing 53*a*, ensuring waterproof of the watch. A module 55 is mounted in the holding portion 52*a* and a pressure sensor 56 is mounted in the holding portion 52*b*.

On the sensor holding portion 52*b*, a protecting plate 58 is provided in front of the pressure sensor 56 through a watertight ring 57 engaged with the outer periphery of the sensor. Furthermore, a fixing member 59 is mounted on the protecting plate 58. The protecting plate 58 and the fixing member 59 are secured to the body 52 with screws (not shown).

The pressure sensor 56 is electrically connected to a conductive flexible substrate 54 which is soldered to an inner wall 56*a* of the sensor 56.

An opposite end 56*b* of the substrate 54 is connected to the module 55 with a screw 60. Thus, the sensor 56 is electrically connected to the module 55.

In operation, the pressure exerted on the sensor 56 is detected and converted into a digital signal by an electronic circuit provided in the module 55 to be displayed on a digital display (not shown) of the watch.

However, such a sensor holding structure has not a sufficient shockproof property. Consequently, if the watch is dropped, the sensor which is precisely made may break by impact. Furthermore, the sensor holding portion has a complicated structure, which requires a troublesome machining. As a result, the number of manufacturing processes increases, causing the cost for the watch to increase.

An object of the present invention is to provide a watch having a sensor which has a sufficient shockproof property and may be easily manufactured at a low cost.

Another object of the invention is to provide a watch having a sensor which has a high waterproof effect.

DISCLOSURE OF THE INVENTION

A watch having a sensor according to the present invention is characterized by a watch case, a sensor holding portion provided in the watch case, the sensor holding portion having a sensor housing space formed therein, a sensor protecting tube secured in the sensor housing space, the sensor being held in the sensor protecting tube in such a position that a sensing portion thereof is outwardly oriented.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

BEST MODE FOR EMBODYING THE INVENTION

Figure 1:
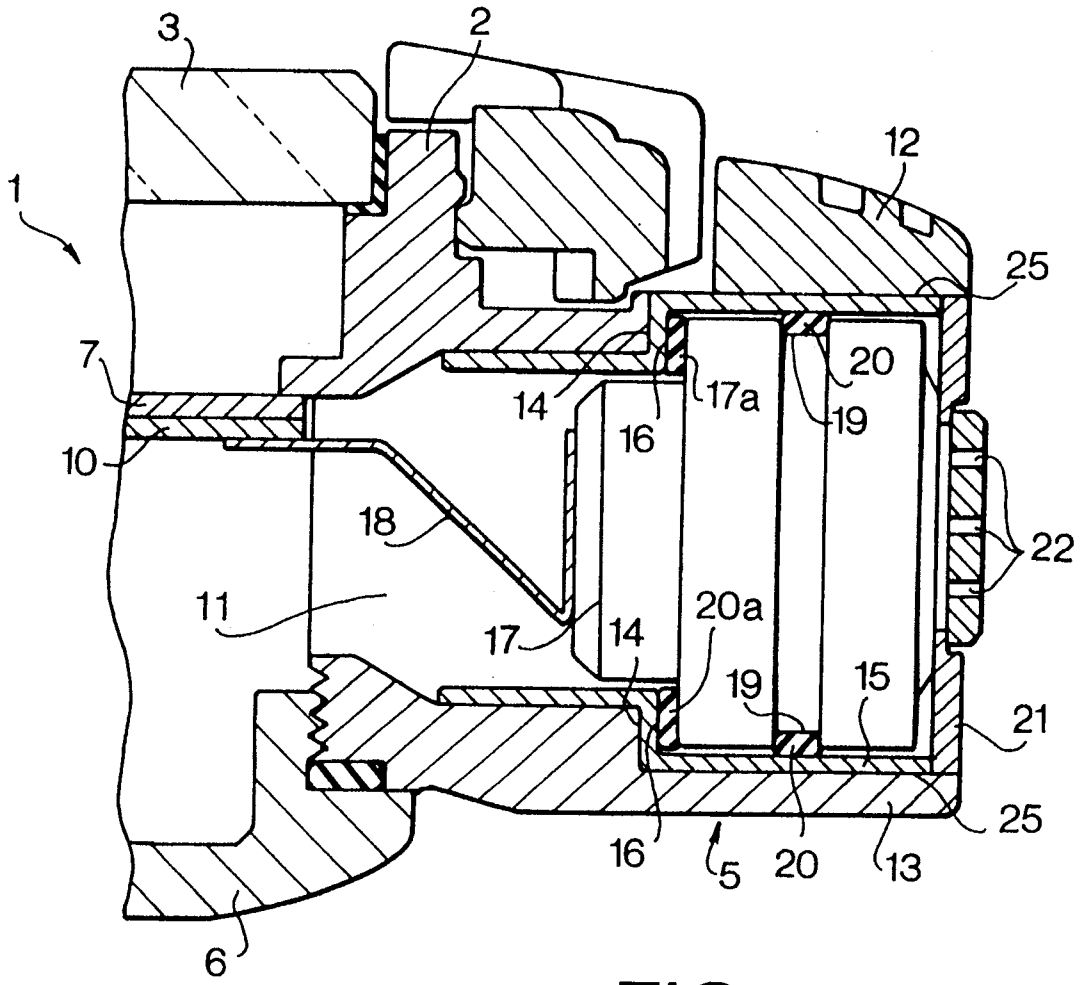
FIG. 1 is a sectional side view showing a main part of a watch having a pressure sensor according to the present invention.
Figure 2:
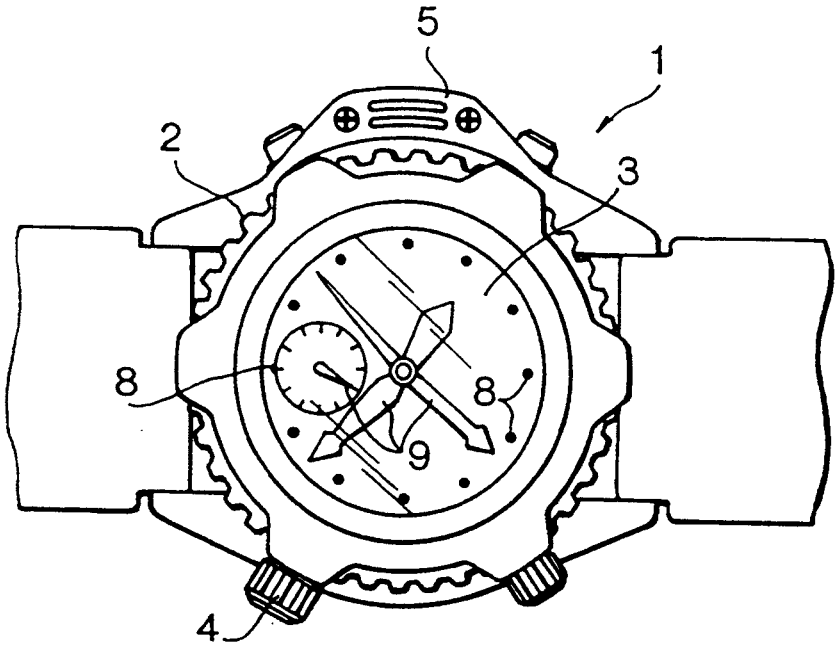
FIG. 2 is a plan view showing the watch.
Figure 3:
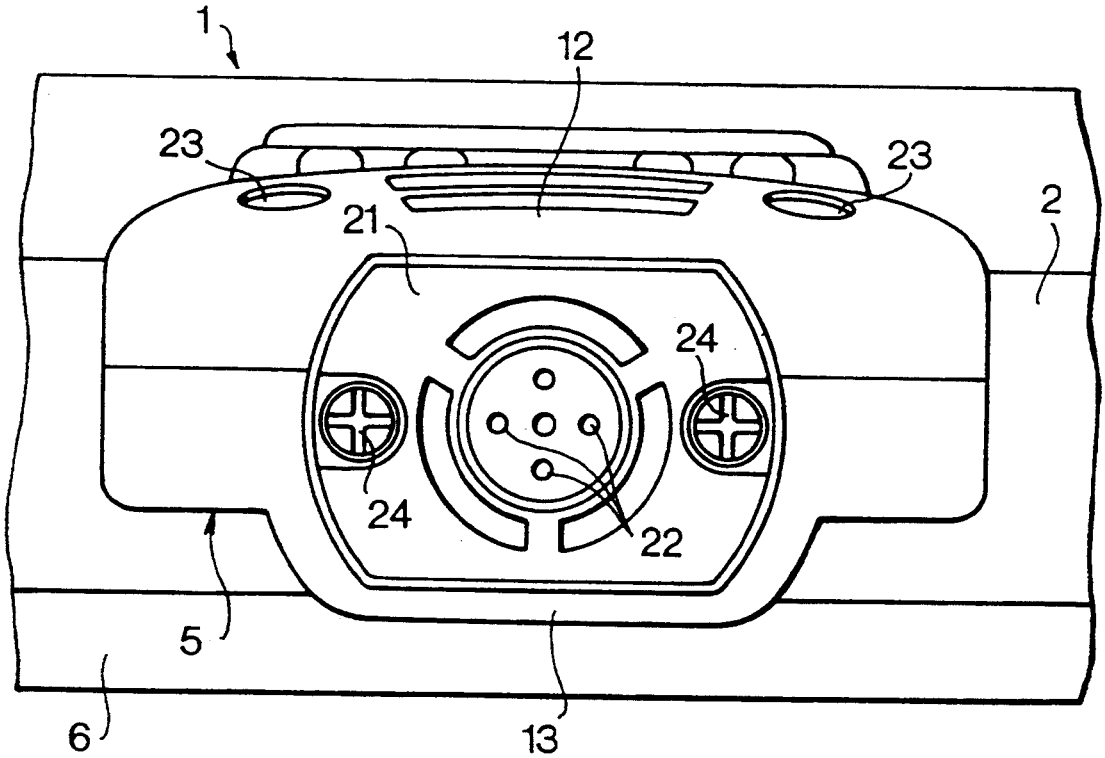
FIG. 3 is an enlarged front view showing the main part of the watch.

Referring to FIGS. 1 to 3 showing a first embodiment of the present invention, a watch is designated with the reference numeral 1. A watch case 2 is made of a comparatively hard metal such as stainless steel. A glass 3 is mounted on an upper portion of the watch case 2. As shown in FIG. 2, on the side of the watch case 2, a crown 4 is provided at the 4 o'clock angular position and a sensor holding portion 5 is provided at the angular position of 9 o'clock both of which are outwardly projected from the watch case.

On the back of the watch case 2, a back 6 is detachably mounted as shown in FIG. 1. A dial 7 is mounted in the watch case under the glass 3 at a distance therefrom. On the dial 7, markings 8 are provided for displaying time and a measured pressure, and hands 9 are provided for indicating the marking 8.

A circuit board 10, battery and driving mechanism (not shown) are provided under the dial 7 for driving the hands.

The sensor holding portion 5 comprises a lower holding portion 13 formed by projecting a part of the watch case 2 and an upper holding member 12 secured to the lower holding portion 13 with screws 23. Between the upper holding member 12 and the lower holding portion 13, a sensor housing space 25 having a circular cross section is defined. The watch case 2 has a sensor housing space 11 formed in the radial direction thereof. The sensor housing space 11 is a circular in cross section and communicated with the sensor housing space 25. The sensor housing space 11 has a diameter smaller than that of the sensor housing space 25, so that a first stepped portion 14 is formed on the inside wall between the holding portion 5 and the case 2.

A sensor protecting tube 15 is mounted in the housing spaces 25 and 11 for protecting a pressure sensor from shock and pressure. The protecting tube 15 is made of copper alloy having a comparatively low hardness, or rigid resin, and comprises a large diameter portion and a small diameter portion, A second stepped portion 16 is formed in the protecting tube 15, corresponding to the first stepped portion 14 of the sensor holding portion 5.

A pressure sensor 17 is inserted into the tube 15 in such a position that a sensing portion (not shown) is outwardly oriented. A flexible printed circuit board 18 connected to the sensor 17 is connected to the circuit board 10.

On the outer periphery of the sensor 17, an annular groove 19 is formed and an annular packing 20 is engaged with the groove 19. The sensor 17 has a third stepped portion 17*a* corresponding to the second stepped portion 16 of the tube 15. An annular packing 20*a* is provided between the second and third stepped portions 17*a* and 16. The packings 20 and 20*a* serve to waterproof the sensor 17 and protect the sensor from shock and pressure.

The outer end of the space 25 is covered by an ornamental plate 21 which is made of stainless steel and secured to the lower holding portion 13 with screws 24. A plurality of apertures 22 are formed in the ornamental plate 21 corresponding to the sensing portion of the sensor 17.

In the embodiment, although the upper holding member 12 is separated from the watch case 2, it can be formed integral with the watch case.

Figure 4:
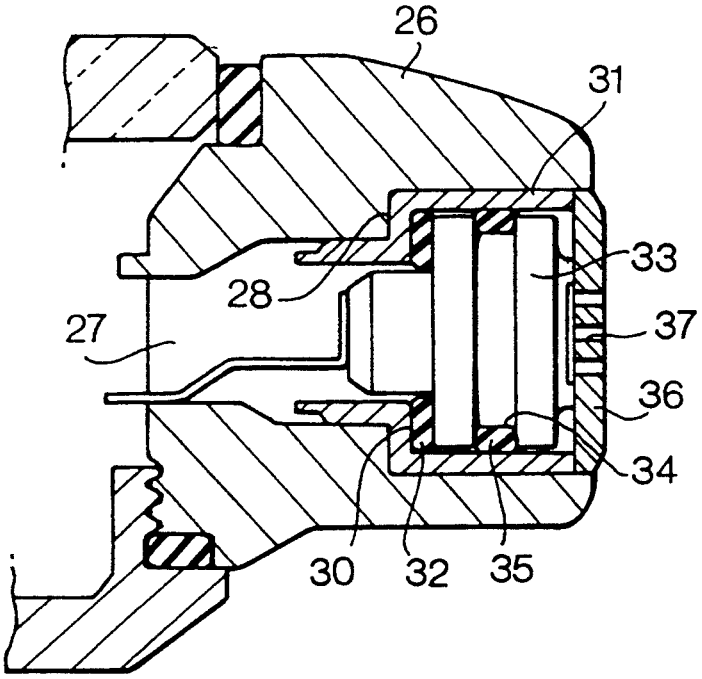
FIG. 4 is a sectional side view of a second embodiment of the present invention.

FIG. 4 shows the second embodiment.

A watch case 26 is made of resin and has a sensor housing space 27 opened to the inside of the watch case. The space 27 has a stepped portion 28 formed on the inside wall at a central portion thereof. A sensor protecting tube 31 made of metal is mounted in the space 27 and secured thereto by force fit, adhesion or welding. The protecting tube 31 has a stepped portion 30 corresponding to the stepped portion 28 of the space 27 so as to be abutted on the stepped portion 28, thereby ensuring the waterproof of the watch.

In order to mount a sensor 33 in the protecting tube 31, a packing 32 is engaged with the stepped portion 30 and a packing 35 is engaged with an annular groove 34 formed on the outer periphery of the sensor 33. The sensor 33 is inserted into the sensor protecting tube 31.

The packings 32 and 35 are provided for waterproofing the sensor 33 and protecting the sensor 33 from impact exerted on the watch case 26. The protecting tube 31 also protects the sensor 33 from shock and pressure.

An ornamental plate 36 is mounted in the space 27 and secured to the protecting tube 31 by screws or welding to cover the sensor 33. The ornamental plate 36 has a plurality of apertures 37 corresponding to a sensing portion of the sensor 33.

Figure 5:
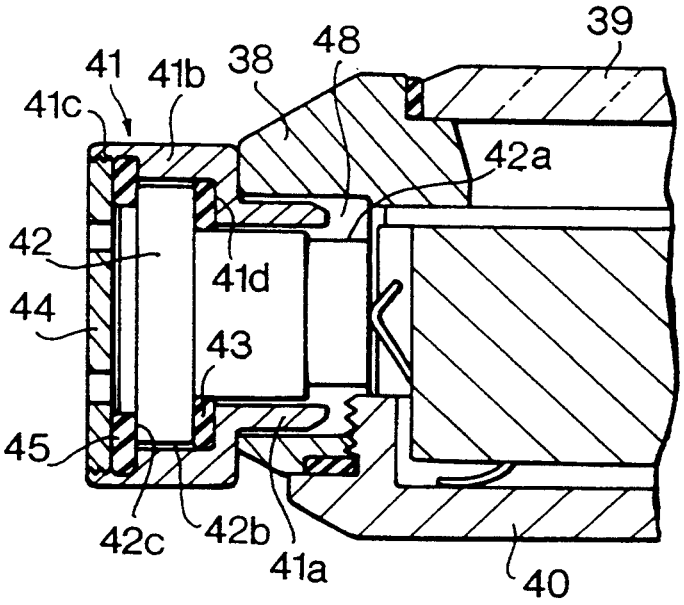
FIG. 5 is a sectional side view of a third embodiment.
Figure 6:
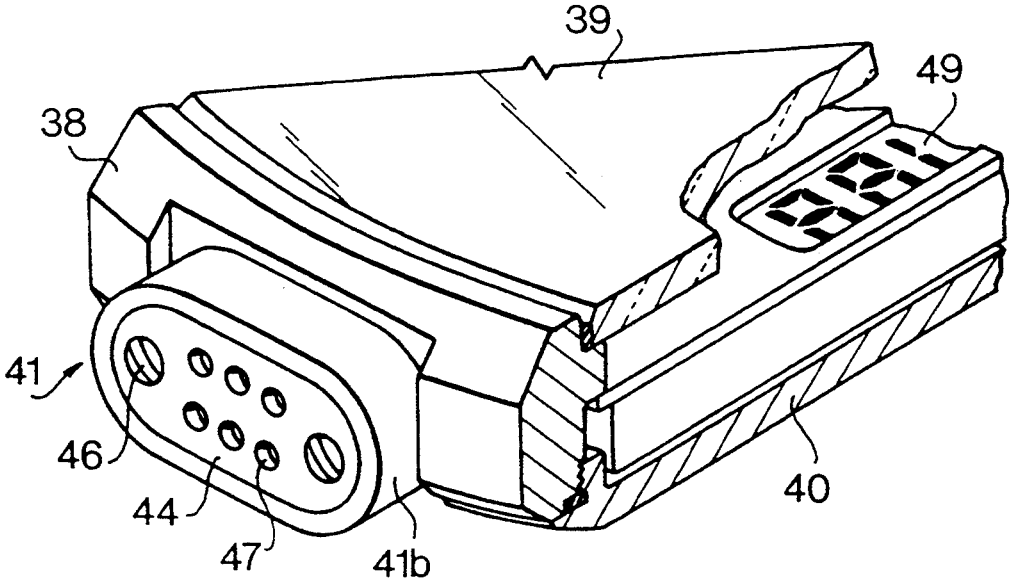
FIG. 6 is a perspective view showing a main part of the third embodiment.
Figure 7:
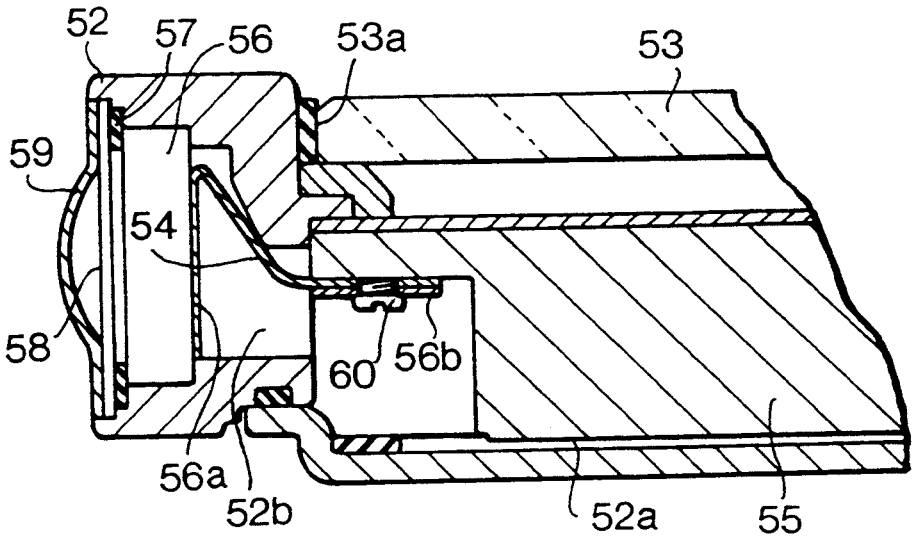
FIG. 7 is a sectional side view of a conventional watch.

FIGS. 5 and 6 show the third embodiment.

A watch case made of metal has a body 38 and a glass 39 mounted on an upper portion of the body. In the back of the body 38, a back 40 is screwed and secured thereto.

A sensor housing space 48 is formed in the body 38. A sensor protecting tube 41 made of metal comprises a small diameter cylindrical portion 41*a*, a large diameter portion 41*b* having an elliptic shape in cross section, an annular inner recessed portion 41*c* formed in the inside wall, and a stepped portion 41*d*. The small diameter portion 41*a* is mounted in the space 48 and secured thereto by force fit, adhesion or welding. A sensor 42 has a small diameter portion 42*a*, a large diameter portion 42*a*, a stepped portion, and an annular recessed portion 42*c* formed on the outer periphery.

In assembling, a packing 43 is engaged with the stepped portion 41*d* of the tube 41, and the sensor 42 is inserted into the tube 41. An ornamental plate 44 is mounted in the recessed portion 41*c*, interposing a packing 45 between the recessed portions 41*c* and 42*c*, and secured to the tube 41 with screws 46 to cover the sensor 42. The ornamental plate 44 has a plurality of apertures 47 formed corresponding to a sensing portion of the sensor 42. The packing 43 is provided to protect the sensor 42 when impact is exerted on the watch case.

The pressure detected by the sensor 42 is displayed on a digital display 49.

PROBABILITY OF INDUSTRIAL EXPLOITATION

In accordance with the present invention, a watch having a sensor has a space formed in a watch case for housing a sensor protecting tube and the sensor is held in the tube. Even if a sensor holding portion is made of hard metal such as stainless steel, the sensor is well adapted to the tube without moving in the watch case. Thus, impact on the holding portion is absorbed, thereby preventing the sensor from damage. Since high accuracy for the sensor housing space is not required, manufacturing process is simplified.

Since the sensor holding portion is divided into a lower portion and an upper member, each of the lower portion and the upper member can be easily molded. It is not necessary to form a hole for the space by boring the case so that the parts can be easily manufactured.

Furthermore, a stepped portion is formed on the wall of the space and packings are provided between the stepped portion and the sensor and between the outside of the sensor and the inside of the protecting tube. When an ornamental plate is secured to the support member and the protecting tube with screws, the packings are compressed. Therefore, even if screws for the ornamental plate are loosened, the sensor does not move by elastic force of the packings, thereby preventing the waterproof property from deteriorating.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A watch comprising:

a watch case;

a sensor holding portion provided in the watch case, the sensor holding portion having a sensor housing space, an axis of which is oriented to a radial direction of said watch case;

a sensor protecting tube secured in the sensor housing space;

a sensor provided in the sensor protecting tube in such a position that a sensing portion thereof is outwardly oriented at a side of the watch case; and two packings provided between the inside wall of the sensor protecting tube and the sensor, one of the packings being disposed to be compressed in the axial direction of the sensor housing space.

2. The watch having a sensor according to claim 1 wherein the sensor holding portion has a lower holding portion integral with the watch case and an upper holding member secured to the lower holding portion.

3. The watch having a sensor according to claim 1 further comprising an ornamental plate having a plurality of apertures which is provided for covering an outer end of the sensor.

4. The watch having a sensor according to claim 1 wherein an inner wall of the sensor housing space has a first stepped portion, the sensor protecting tube has a large diameter portion, a small diameter portion, and a second stepped portion formed between the large and small diameter portions, corresponding to the first stepped portion, the sensor has a third stepped portion corresponding to the second stepped portion, a packing is provided between the second stepped portion and the third stepped portion.

5. The watch having a sensor according to claim 1 wherein the watch case is made of metal.

6. The watch having a sensor according to claim 1 wherein the watch case is made of resin and the sensor housing space is defined by a hole formed in a side wall of the watch case.

7. The watch having a sensor according to claim 4 wherein the large diameter portion of the sensor protecting tube is outwardly projected from the watch case and an outside wall of the second stepped portion is abutted on an outside wall of the watch case.

* * * * *